US009924782B1

(12) United States Patent
Burke

(10) Patent No.: US 9,924,782 B1
(45) Date of Patent: Mar. 27, 2018

(54) DOUBLE PORTABLE ELECTRONIC DEVICE CARRIER

(71) Applicant: Michelle Burke, Reno, NV (US)

(72) Inventor: Michelle Burke, Reno, NV (US)

( * ) Notice: Subject to any disclaimer, the term of this patent is extended or adjusted under 35 U.S.C. 154(b) by 0 days.

(21) Appl. No.: 15/594,858

(22) Filed: May 15, 2017

(51) Int. Cl.

| | |
|---|---|
| ***A45F 4/02*** | (2006.01) |
| ***A45C 13/26*** | (2006.01) |
| ***A45F 5/10*** | (2006.01) |
| ***A45C 13/00*** | (2006.01) |
| *A45F 4/00* | (2006.01) |
| *A45C 11/00* | (2006.01) |
| *A45F 3/00* | (2006.01) |

(52) U.S. Cl.
CPC ..... *A45F 4/02* (2013.01); *A45C 13/002* (2013.01); *A45C 13/26* (2013.01); *A45F 5/1026* (2013.01); *A45C 2011/002* (2013.01); *A45F 4/00* (2013.01); *A45F 5/10* (2013.01); *A45F 2003/001* (2013.01); *A45F 2004/003* (2013.01)

(58) Field of Classification Search
CPC .. A45F 4/02; A45F 5/1026; A45F 4/00; A45F 5/10; A45F 2003/001; A45F 2004/003; A45C 13/002; A45C 13/26; A45C 2011/002
See application file for complete search history.

(56) References Cited

U.S. PATENT DOCUMENTS

| | | | | |
|---|---|---|---|---|
| 5,544,792 | A * | 8/1996 | Arnwine | A45C 7/0086 224/153 |
| 2008/0041897 | A1* | 2/2008 | Malhotra | A45C 11/00 224/199 |
| 2014/0091689 | A1* | 4/2014 | Mishan | H05K 5/02 312/237 |
| 2015/0201742 | A1* | 7/2015 | Tomko | A45F 5/00 224/219 |
| 2015/0366332 | A1* | 12/2015 | Marji | A45F 3/04 224/583 |

OTHER PUBLICATIONS

Story Leather, Double Cartera, Jan. 21, 2014 (https://www.storyleather.com/blog/2014/01/showcase-double-cartera).*
"PearPeel." Found online, Mar. 24, 2017, at www.pearpeel.com. Retrieved from www.pearpeel.com/#about.
"Story Leather Double Decker." Found online, Mar. 24, 2017, at www.storyleathercom. Retrieved from http://www.storyleather.com/double-decker-holster-2-phones.html.

* cited by examiner

*Primary Examiner* — Corey Skurdal
(74) *Attorney, Agent, or Firm* — Steinberg Intellectual Property Law LLC; Gloria M. Steinberg, Esq.

(57) ABSTRACT

Disclosed is a double carrier device for handheld electronic devices. The carrier device includes a first case and a second case, wherein each of the two cases is configured to hold a mobile device therein. The two cases can be removably attached to each other via a fastening mechanism disposed on each of the cases. The fastening mechanism includes a strap and a fastener that is configured to hold the two mobile devices together therein in a substantially side-by-side or stacked configuration within the two cases. In a preferred embodiment, the two cases are substantially equal in size and dimension so as to form a unitary structure when attached together.

14 Claims, 7 Drawing Sheets

DOUBLE PORTABLE ELECTRONIC DEVICE CARRIER

FIELD OF THE INVENTION

The present invention relates generally to accessories for portable electronic devices. More particularly, the present invention is directed to a carrier for multiple portable electronic devices.

BACKGROUND OF THE INVENTION

Various types of handheld electronic devices are ubiquitous in modern day life. In fact, it is not uncommon for individuals to carry a handheld electronic device such as a mobile phone for personal use, and a second device (e.g., another mobile phone) for business use. Individuals with multiple devices often carry the devices together, but it can cause great inconvenience and annoyance to have to look for these devices individually in a bag, for instance, and then verify that the individual has found the right device for appropriate use. In some instances, individuals carry identical devices for both personal and business use, so it can be even more time consuming and confusing to determine whether the device is for personal use or business use.

Some devices in the prior art disclose carriers or cases for two mobile devices. However, these devices are generally designed to carry or store two mobile devices of the same size and shape. Additionally, these devices comprise separate pockets or sections for sliding the mobile devices therein. In this regard, the screens on the mobile devices are not readily accessible. Thus, there is a need for maintaining multiple handheld electronic devices of various sizes and shapes in an organized manner while providing access to the same. In this regard, the invention described herein addresses these problems.

SUMMARY OF THE INVENTION

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as to prelude to the more detailed description that is disclosed later.

Some embodiments of the present invention comprise a carrier device comprising a first case and a second case, wherein each of the two cases is configured to hold a mobile device therein. Additionally, the two cases can accommodate two mobile devices of different sizes and shapes. In this regard, the carrier device may be used with different device models and device types. The two cases can be removably attached to each other via a fastening mechanism to hold the two mobile devices together therein in a substantially side-by-side or a stacked configuration. In a preferred embodiment, the two cases are substantially equal in size and dimension so as to form a unitary structure when attached together.

Without limitation, the fastening mechanism comprises snap fasteners having a female and a male snap, tie closures, magnetic closures, zippers, hook and loop closures, hook and eye closures, and buckles, among others. The specific type of the fastening mechanism, however, is not of primary relevance with regard to the intent of the present invention, which portends to provide two individual cases that can removably attach together in order to maintain two or more mobile devices together in an organized manner while allowing the devices to be used separately, if desired.

It is, therefore, an objective of the present invention to provide a new and improved electronic device carrier that can be used to store and transport two or more devices.

It is another objective of the present invention to provide a new and improved electronic device carrier that can be used to store and transport handheld devices of different sizes and shapes.

It is still another objective of the present invention to provide a new and improved electronic device carrier that can be easily worn on person.

It is still another objective of the present invention to provide a new and improved electronic device carrier that comprises a first case and a second case that can be removably attached to each other to secure two handheld electronic devices together.

A final objective of the present invention to provide a new and improved electronic device carrier that may be readily fabricated from materials that permit relative economy and commensurate with durability.

In the light of the foregoing, these and other objectives are accomplished in accordance with the principles of the present invention, wherein the novelty of the present invention will become apparent from the following detailed description and appended claims.

BRIEF DESCRIPTION OF THE DRAWINGS

The above and other objects and advantages of the present invention will be apparent upon consideration of the following detailed description, taken in conjunction with the accompanying exemplary drawings, in which like reference characters refer to like parts throughout, and in which.

DETAILED DESCRIPTION OF THE INVENTION

The present invention is directed towards a carrier device for electronic devices. For purposes of clarity, and not by way of limitation, illustrative views of the present invention are described with references made to the above-identified figures. Various modifications obvious to one skilled in the art are deemed to be within the spirit and scope of the present invention.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to disclose concepts in a concrete fashion. As used in this application, the term "or" is intended to mean an inclusive "or" rather than an exclusive "or."

Additionally, the articles "a" and "an" as used in this application and the appended claims should generally be construed to mean "one or more" or "at least one" unless specified otherwise or clear from context to be directed to a singular form. Similarly, the terms "plurality" and "a plurality" as used herein includes, for example, "multiple" or "two or more." For example, "a plurality of items" includes two or more items.

Figure 1:
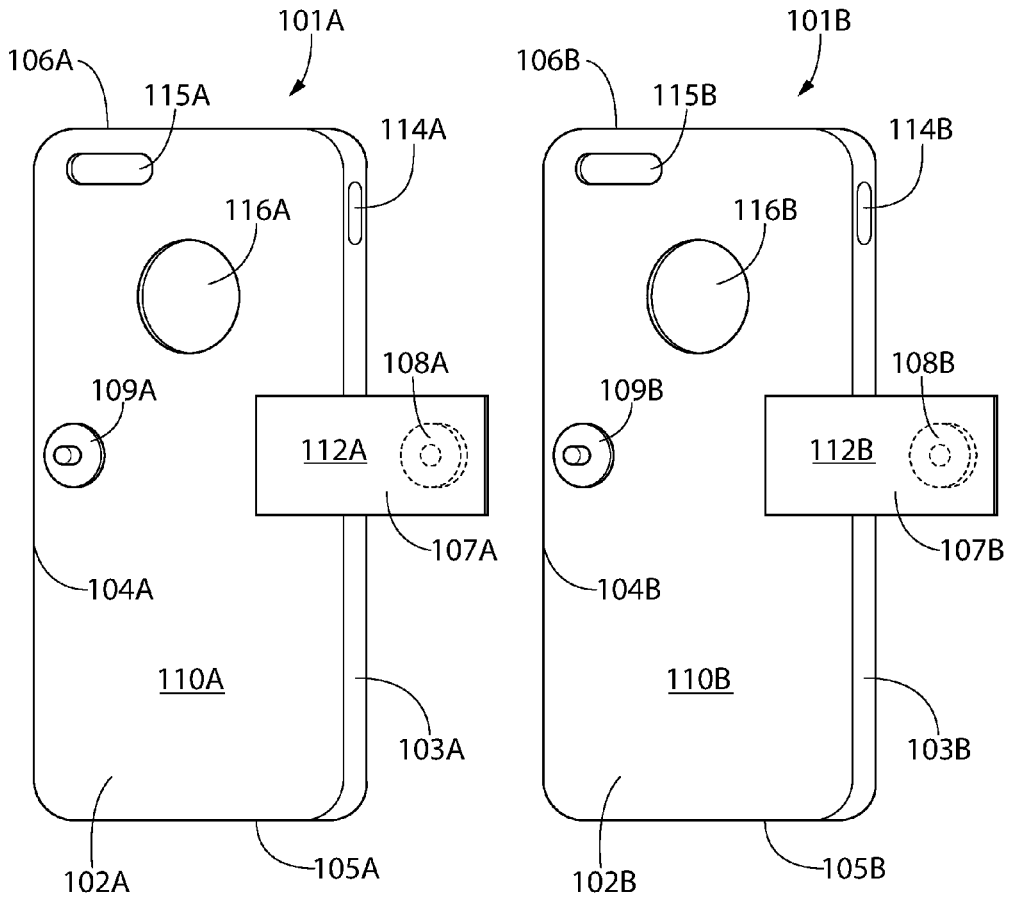
FIG. 1 depicts an exterior view of an exemplary embodiment of the first and second cases of the double portable electronic device carrier side-by-side.
Figure 2:
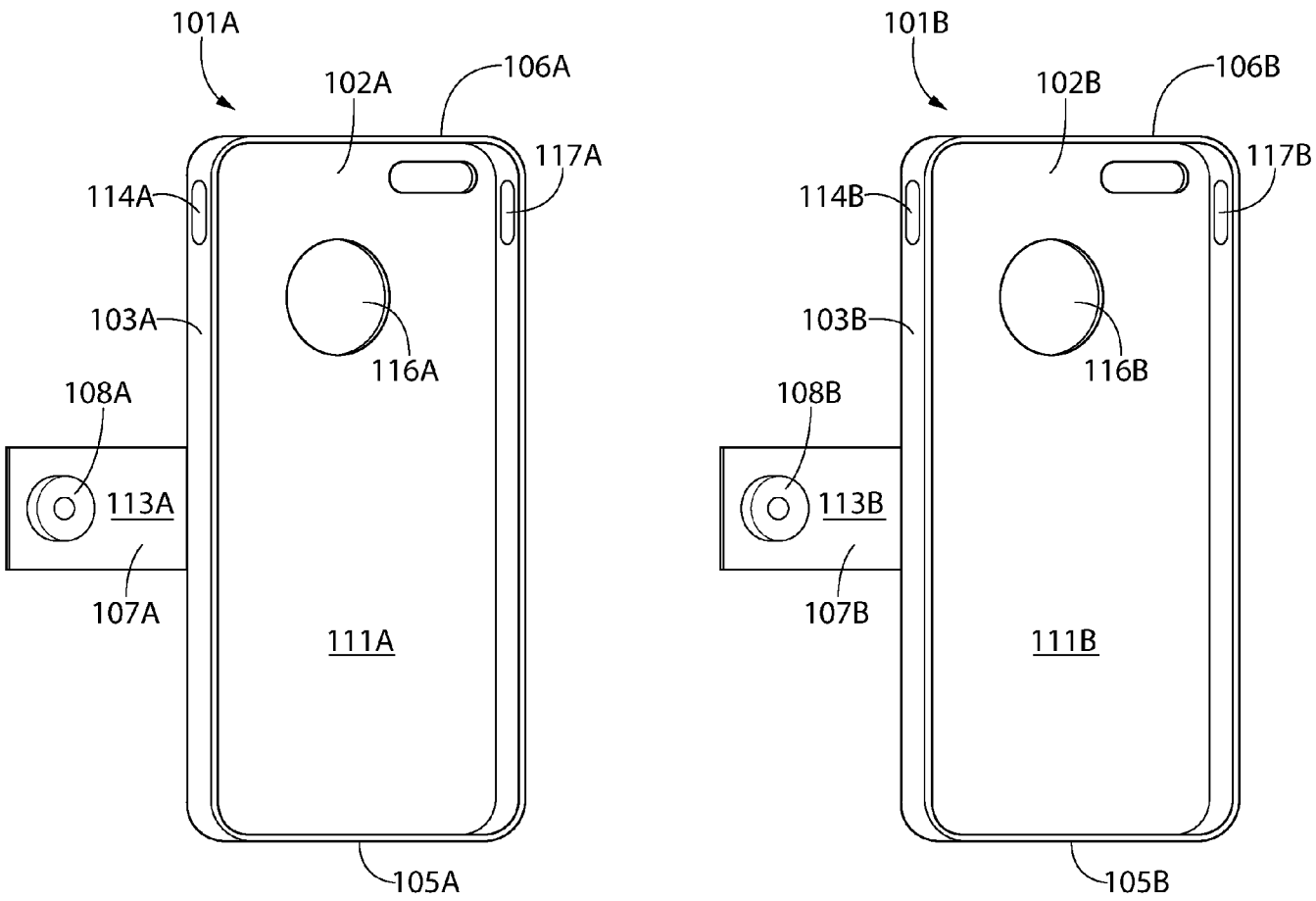
FIG. 2 depicts an interior view of the exemplary embodiment of the first and second cases of the present invention.

Referring now to FIGS. 1 and 2, there are shown exterior and interior views of an exemplary embodiment of the device carrier of the present invention. The carrier comprises a first case 101A and a second case 101B that can be removably attached to each other. Each of the first case 101A and the second case 101B comprises a substantially rectangular prism shaped housing member with rounded corners having a back wall 102A, 102B with a top wall 106A, 106B, side walls 103A, 103B, 104A, 104B, and a bottom wall 105A, 105B extending perpendicularly therefrom, leaving the front open and defining an interior volume to hold a handheld electronic device (e.g., a mobile phone, a personal digital assistant, an e-reader, a tablet computer, etc.) therein. Preferably, the first case 101A and the second case 101B are substantially equal in size and dimension.

The interior surface 111A, 111B of the back wall 102A, 102B is biased toward the open front and the exterior surface 110A, 110B of the back wall 102A, 102B is coextensive and opposite thereto, thus biased away from the open front. The exterior surface 110A, 110B of the back wall 102A, 102B comprises a fastening strap 107A, 107B attached thereto. It is contemplated that a proximal end of the fastening strap 107A, 107B is sewn onto the back wall 102A, 102B or secured onto the back wall 102A, 102B via adhesives, depending upon embodiments. In the illustrated embodiment, the fastening strap 107A, 107B is located at a substantial midpoint between the top and bottom edges of the back wall 102A, 102B or between the top wall 106A, 106B and the bottom wall 105A, 105B. Additionally, the fastening strap 107A, 107B is biased toward the first side wall 103A, 103B. A distal end of the fastening strap 107A, 107B on the interior surface 113A, 113B of the strap 107A, 107B comprises a first fastener (e.g., a female snap) 108A, 108B thereon.

The exterior surface 110A, 110B of the back wall 102A, 102B further comprises a second fastener 109A, 109B disposed biased toward the second side wall 104A, 104B. The second fastener 109A, 109B is also located at a substantial midpoint between the top and bottom edges of the back wall 102A, 102B or between the top wall 106A, 106B and the bottom wall 105A, 105B. In this regard, the second fastener 109A, 109B is located substantially opposite the first fastener 108A, 108B on the fastening strap 107A, 107B. In use, the first fastener 108A of the first case 101A is configured to mate with the second fastener 109B of the second case 101B, and the first fastener 109B of the second case 101B is configured to mate with the second fastener 109A of the first case 101A.

In some embodiments, the terminal edges of the top wall 106A, 106B, bottom wall 105A, 105B, and side walls 103A, 103B, 104A, 104B comprise a lip or a curve. The lip or the curve is continuously formed around the perimeter of the case so as to allow the case to secure onto a handheld electronic device via a snap fit or friction fit. Additionally, the lip or the curve prevents contents within the case from escaping the case when the case is attached to the other case in a closed configuration.

In some embodiments, the back wall 102A, 102B can further comprise one or more openings 114A, 114B, 115A, 115B, 116A, 116B, 117A, 117B thereon for allowing access to the back of the device while the device is inside of the case 101A, 101B. For instance, one or more openings 115A, 115B can align with a camera on the device so as to allow the device's camera to function without requiring the device to be removed from the case 101A, 101B. Similarly, the side walls 103A, 103B, 104A, 104B of the case 101A, 101B can comprise one or more openings 114A, 114B, 117A, 117B thereon for allowing access to control buttons disposed on the sides of the device (e.g., volume button, power button, etc.).

Figure 3:
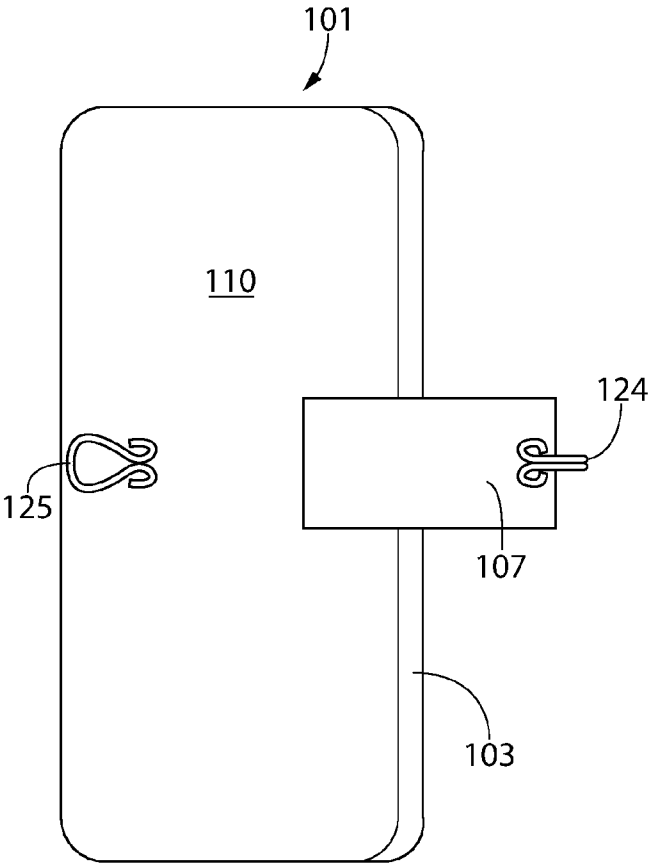
FIG. 3 shows an exterior view of a second embodiment of the present invention.

Referring now to FIGS. 3 through 6, there are shown alternate embodiments of the present invention. The snap fasteners 108A, 108B, 109A, 109B (FIGS. 1, 2) on the first and second cases 101A, 101B (FIGS. 1, 2) can be replaced with various fastening means such as hook and eye closures 124, 125, as depicted in FIG. 3, wherein the hook 124 is disposed on the fastening strap 107 and the eye closure 125 is biased toward the second side wall on the exterior surface 110 of the back wall.

Figure 4:
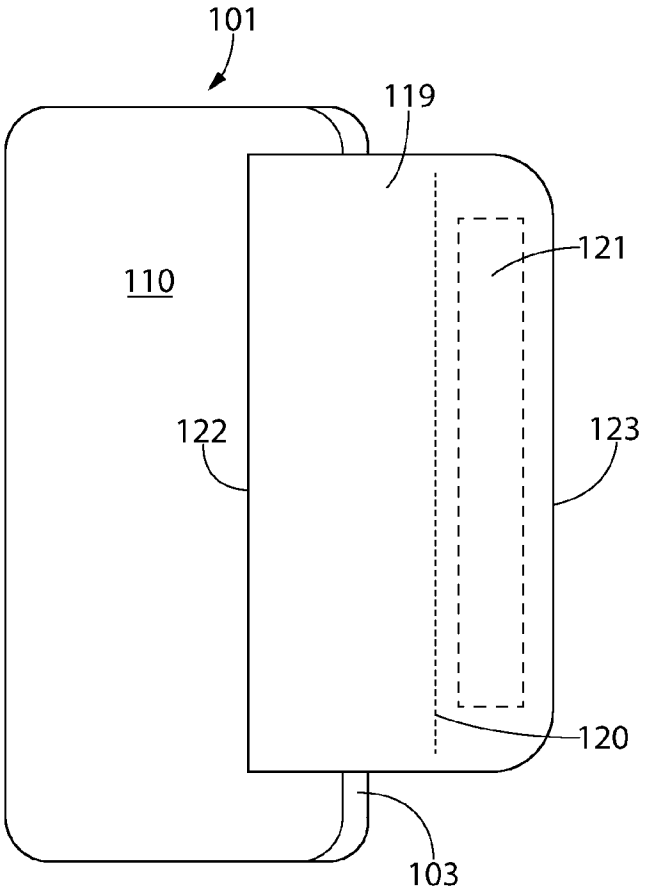
FIG. 4 shows an exterior view of a third embodiment of the present invention.
Figure 5:
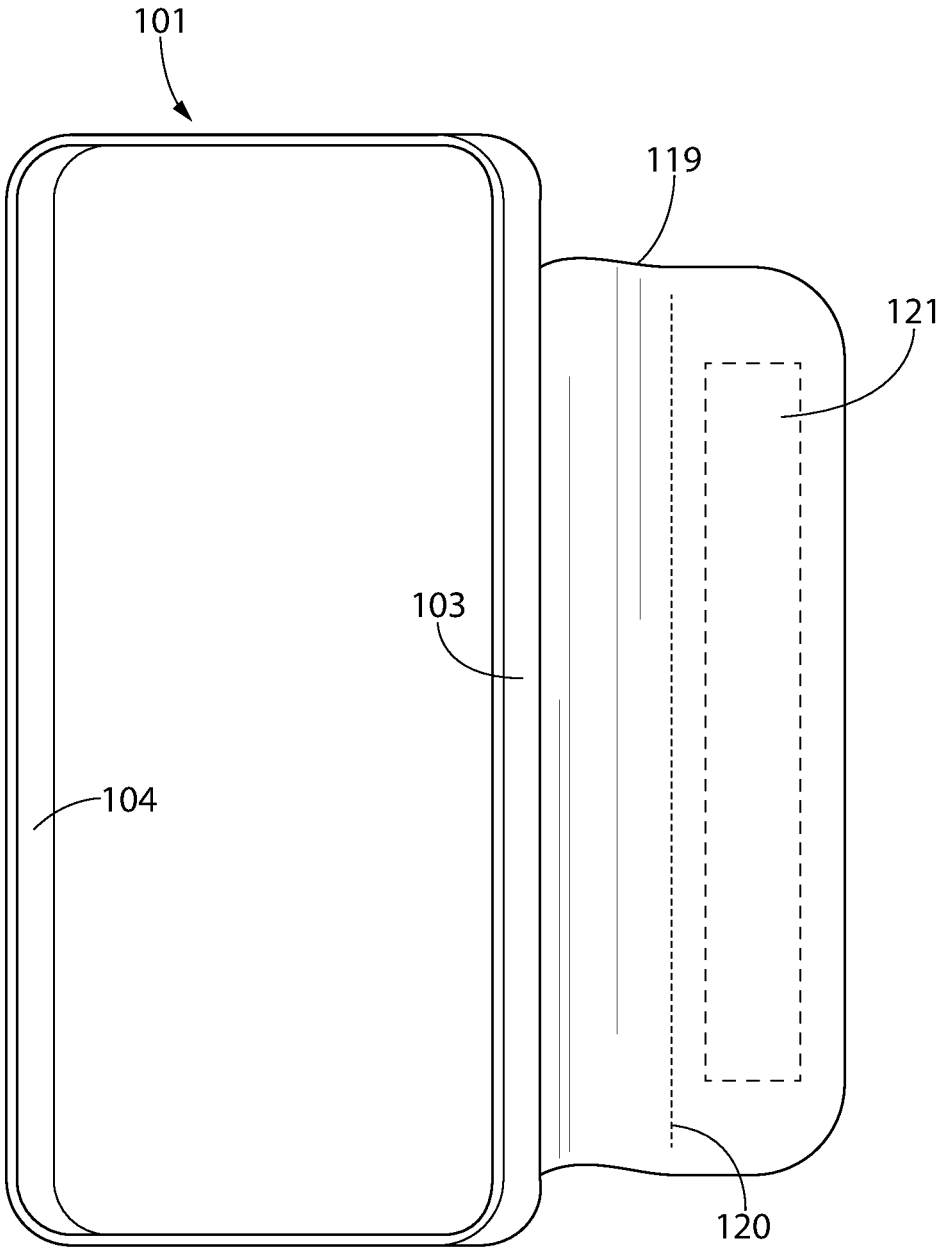
FIG. 5 shows an interior view of the third embodiment of the present invention.

Alternatively, the cases can comprise an attachment portion 120 comprising a magnetic closure 121 as depicted in FIGS. 4 and 5. In such embodiments, the attachment portion 120 is attached near the first side wall 103. In the illustrated embodiment, the attachment portion 120 spans substantially between the top and bottom edges of the back wall or between the top wall and the bottom wall. The attachment portion 120 comprises a folding line between a flexible section 119 and a rigid section 123 comprising a magnetic strip or a magnet 121 embedded therein. The flexible section 119 can wrap partially around the first side wall 103 of the first case and the second side wall 104 of the second case. The magnet 121 on the rigid section removably attaches to the exterior surface of the back wall to secure two cases together.

In this regard, it is contemplated that the back wall comprises a second magnetic strip or a second magnet embedded therein, wherein the second magnetic strip or the second magnet is biased toward a second side wall 104. Alternatively, the back wall comprises an embedded metal strip that is biased toward the second side wall 104. In this way, the magnet in the rigid section of the first case can engage the second magnetic strip or the metal strip of the second case and the magnet in the rigid section of the second case can engage the first magnetic strip or the metal strip of the first case. In some embodiments, the cases are entirely composed of a metal or other magnetic material. In this regard, a second magnetic strip, a second magnet, or an embedded metal strip is not needed.

Figure 6:
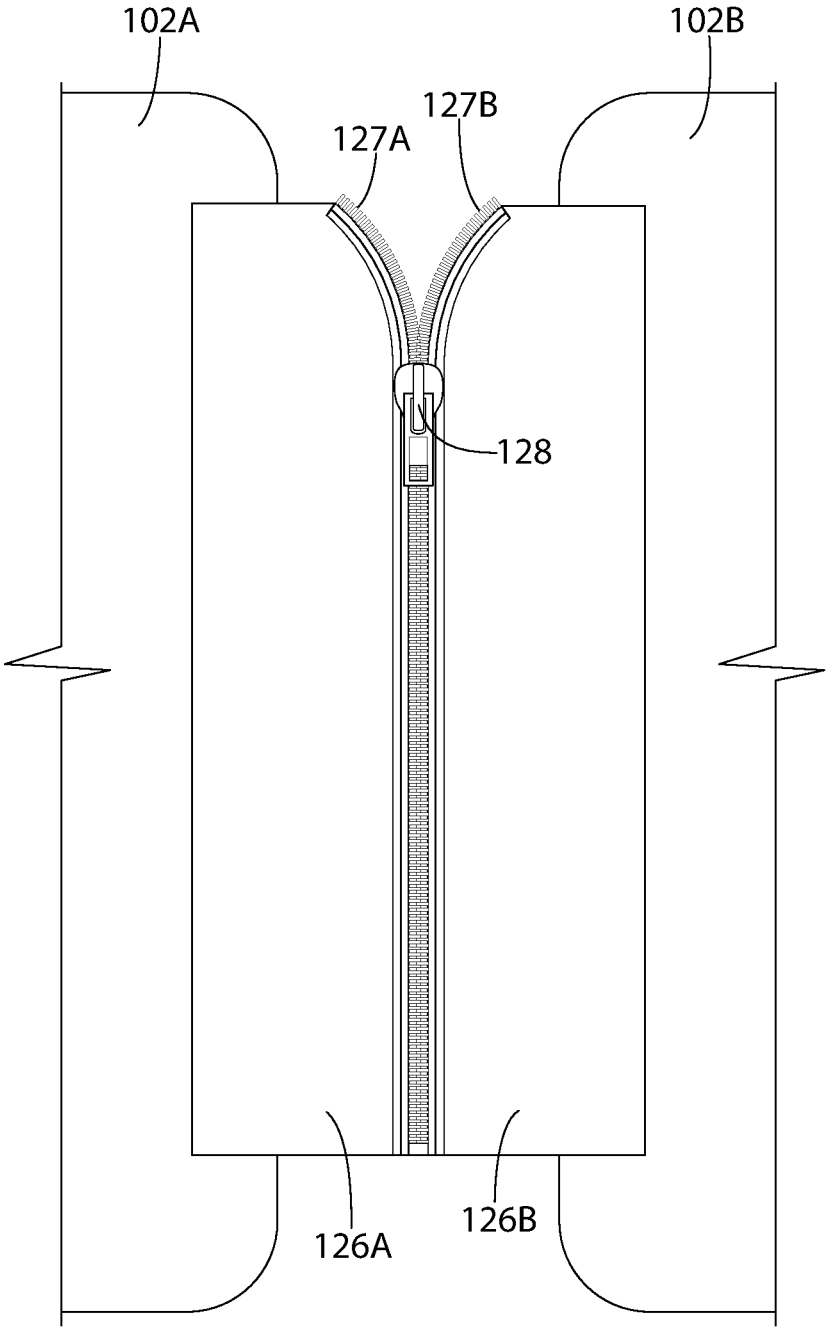
FIG. 6 shows an exterior view of a fourth embodiment of the present invention.

Similarly, some embodiments of the invention comprise an attachment portion 126A, 126B having zippers 127A, 127B with a zipper head 128 thereon, wherein the attachment portion 126A, 126B is disposed on the back wall 102A, 102B as depicted in FIG. 6. In such embodiments, the first case and the second case are mirror images of each other. Thus, the first case can comprise an attachment portion 126A on a first side thereof, and the second case can comprise an attachment portion 126B on a second side thereof, such that the two cases can be positioned side by side in order to engage the zippers 127A, 127B on the attachment portions 126A, 126B.

Figure 7:
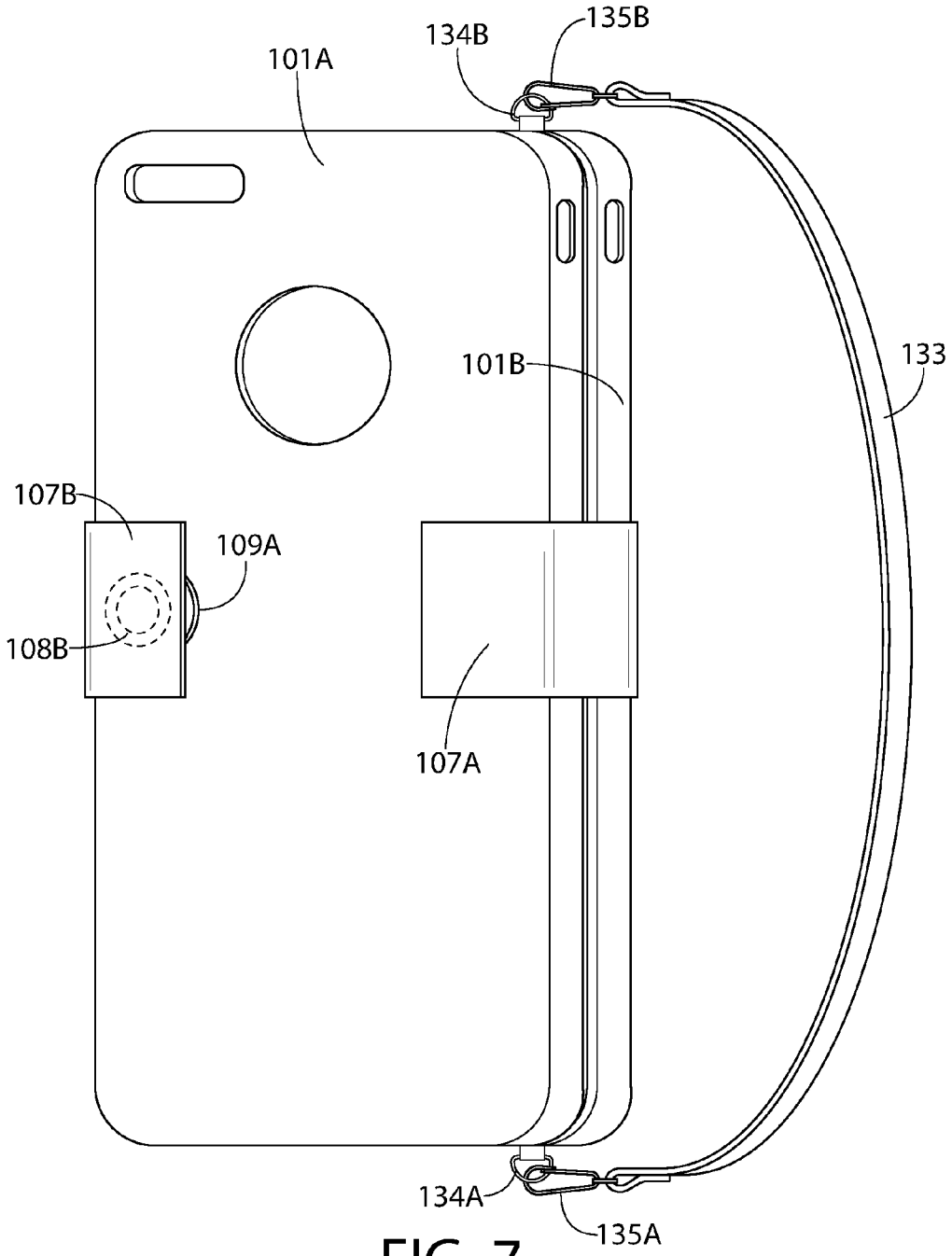
FIG. 7 shows a view of the present invention in a closed configuration.
Figure 8:
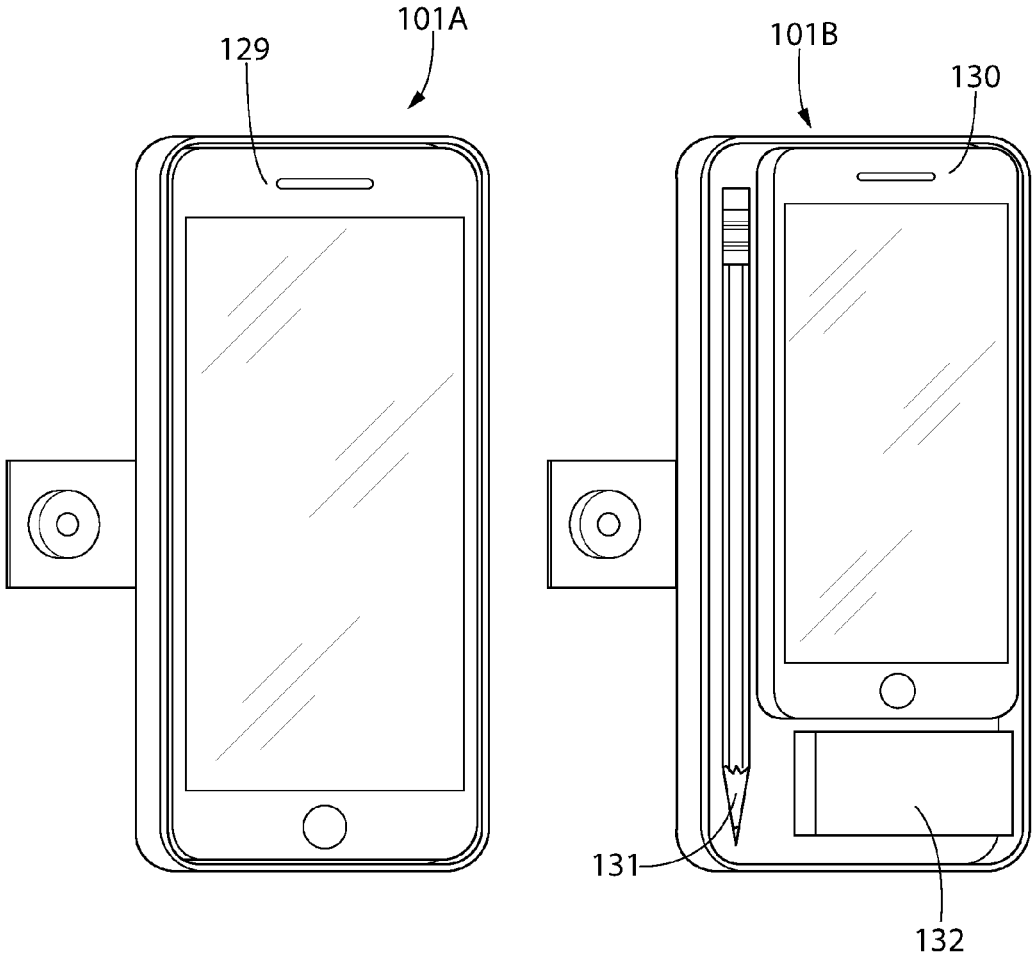
FIG. 8 shows an interior view of the present invention in an open configuration with mobile devices in each of the cases.

Referring now to FIGS. 7 and 8, there are shown views of the first case 101A and the second case 101B in a closed configuration and in an open configuration, respectively. When in a closed configuration, the first case 101A and the second case 101B are aligned and then attached together such that the top wall, the bottom wall, and the side walls of the first case 101A directly contact the top wall, the bottom wall, and the side walls of the second case 101B, respectively. Said another way, the top wall of the first case meet the top wall of the second case, the bottom wall of the first case meet the bottom wall of the second case, and the side walls of the first case meet the side walls of the second case.

The fastening strap 107A of the first case 101A is partially wrapped around the first case 101A and the second case 101B, and then the first fastener on the fastening strap 107A of the first case 101A is attached to the second fastener on the second case 101B. Similarly, the fastening strap 107B of the second case 101B is partially wrapped around the second case 101B and the first case 101A, and then the first fastener 108B on the fastening strap 107B of the second case 101B is attached to the second fastener 109A on the first case 101A. To access the mobile devices for a brief use (e.g., to access the touch screen), only one of the fastening strap 107A, 107B need be disengaged. To use the mobile devices separately, both fastening straps 107A, 107B can be disengaged, but the mobile devices can remain in each of the respective cases.

In some embodiments, the carrier further comprises one or more loops or clips for attaching to a belt or a handle 133 thereon, wherein the handle 133 can be removably attached to the carrier. The loop, clip, and/or the handle 133 can be attached to various parts of the case 101A, 101B. In the illustrated embodiment, a first terminal end of the handle 133 is attached the first case 101A and a second terminal end of the handle is attached to the second case 101B. More specifically, the first case 101A comprises a first D-ring 134A that can removably connect to a first clip 135A at the first terminal end of the handle 133. Similarly, the second case 101B comprises a second D-ring 134B that can removably connect to a second clip 135B at the second terminal end of the handle 133.

As described above, the cases 101A, 101B can accommodate mobile devices of various shapes and sizes. In this regard, the two devices need not be of the same shape and size. In the illustrated embodiment, the first case 101A comprises a mobile device 129 that takes up the entire case. In contrast, the second case 101B comprises a smaller mobile device 130 that does not take up the entire space. Thus, the second case can be used to store additional items 131, 132 such as pencils, pen, USB drive, and the like.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A double electronic device carrier, comprising:

a first case and a second case with a defined interior volume configured to hold a mobile device therein;

each of said first case and said second case comprising a back wall having a top wall, a bottom wall, a first side wall, and a second side wall extending perpendicularly therefrom;

a fastening strap attached to said back wall of each of said first case and said second case, wherein said fastening strap comprises a proximal end and a distal end;

said distal end of said fastening strap comprising a first fastener thereon;

a second fastener attached to said back wall of each of said first case and said second case, wherein said first fastener of said first case is configured to mate with said second fastener of said second case and said first fastener of said second case is configured to mate with said second fastener of said first case; and wherein said fastening strap is biased toward said first side wall and said second fastener is biased toward said second side wall.

2. The double electronic device carrier of claim 1, wherein said first fastener and said second fastener comprise hook and loop fasteners.

3. The double electronic device carrier of claim 1, wherein said first fastener and said second fastener comprise snap fasteners.

4. The double electronic device carrier of claim 1, wherein said first fastener and said second fastener comprise tie closures.

5. The double electronic device carrier of claim 1, wherein said first fastener and said second fastener comprise magnetic closures.

6. The double electronic device carrier of claim 1, wherein said first fastener and said second fastener comprise hook and eye closures.

7. The double electronic device carrier of claim 1, wherein said fastening strap is located at a substantial midpoint between a top edge and a bottom edge of said back wall.

8. The double electronic device carrier of claim 1, wherein said fastening strap spans substantially between a top edge and a bottom edge of said back wall.

9. The double electronic device carrier of claim 1, wherein said first side wall comprises one or more openings.

10. The double electronic device carrier of claim 1, wherein said back wall comprises one or more openings.

11. The double electronic device carrier of claim 1, wherein terminal edges of said top wall, said bottom wall, said first side wall, and said second side wall comprise a lip.

12. The double electronic device carrier of claim 1, further comprises a handle.

13. A double electronic device carrier, comprising:

a first case and a second case with a defined interior volume configured to hold a mobile device therein;

each of said first case and said second case comprising a back wall having a top wall, a bottom wall, a first side wall, and a second side wall extending perpendicularly therefrom;

a fastening strap attached to said back wall of each of said first case and said second case, wherein said fastening strap comprises a proximal end and a distal end;

said distal end of said fastening strap comprising a first fastener thereon;

a second fastener attached to said back wall of each of said first case and said second case, wherein said first fastener of said first case is configured to mate with said second fastener of said second case and said first fastener of said second case is configured to mate with said second fastener of said first case; and wherein said fastening strap of said first case is biased toward said first side wall and said fastening strap of said second case is biased toward said second side wall.

14. The double electronic device carrier of claim 13, wherein said first fastener and said second fastener comprise zippers.

* * * * *